US005172902A

United States Patent [19]

Hashimoto et al.

[11] Patent Number: 5,172,902

[45] Date of Patent: Dec. 22, 1992

[54] PAPER STORING DEVICE WITH A SWINGABLE ENGAGING MEMBER AND AN ENGAGING/DETACHING MECHANISM

[75] Inventors: Yasuhiro Hashimoto, Kyoto; Toru Tanjyo, Toyonaka, both of Japan

[73] Assignee: Mita Industrial Co., Ltd., Japan

[21] Appl. No.: 792,618

[22] Filed: Nov. 15, 1991

[30] Foreign Application Priority Data

Nov. 27, 1990 [JP] Japan ..... 1-326650

[51] Int. Cl.[5] ..... B65H 1/22; B65H 1/00

[52] U.S. Cl. ..... 271/164; 271/171

[58] Field of Search ..... 271/164, 171, 223

[56] References Cited

U.S. PATENT DOCUMENTS

| | | | |
|---|---|---|---|
| 2,398,315 | 4/1946 | Little | 271/171 |
| 3,847,387 | 11/1974 | Sick | 271/171 |
| 3,862,753 | 1/1975 | Giorgini | 271/171 |
| 3,921,972 | 11/1975 | Miller | 271/171 |
| 3,934,870 | 1/1976 | Miller et al. | 271/171 |
| 4,231,566 | 11/1980 | Suzuki | 271/171 |
| 5,076,562 | 12/1991 | Sai et al. | 271/171 |

FOREIGN PATENT DOCUMENTS

| | | | |
|---|---|---|---|
| 139833 | 6/1988 | Japan | 271/164 |

OTHER PUBLICATIONS

Campbell, et al., "Elevating Paper Supply Drawer", *IBM Technical Disclosure Bulletin*, vol. 17, No. 3, pp. 670–671 (Aug. 1974).

Riley, "Paper Tray Side Guides", *Xerox Disclosure Journal, vol. 4, No. 5, p. 627 (Sep./Oct. 1979).*

*Primary Examiner*—Robert P. Olszewski

*Assistant Examiner*—Steven M. Reiss

*Attorney, Agent, or Firm*—Beveridge, DeGrandi & Weilacher

[57] ABSTRACT

In a paper feeding device, a paper feeding deck which moves back and forth is provided with a guide bar which extends in the direction in which the paper feeding deck moves and which has grooves formed in required portions corresponding to the sizes of recording paper sheets. A width aligning guide supporting member guided by the guide bar is fixed to a width aligning guide. The width aligning guide supporting member is provided with an engaging member detachably engagable with a groove of the guide bar. In addition, an engaging and detaching mechanism is provided for the width aligning guide supporting member. The engaging member is detachable from a groove of the guide bar by the engaging and detaching mechanism and then, the width aligning guide, along with the width aligning guide supporting member, can be moved to a position corresponding to the size of the recording paper sheets. The engaging member then is engaged with another groove of the guide bar by the engaging and detaching mechanism. Consequently, the width aligning guide is stably supported on the guide bar in a predetermined position.

9 Claims, 5 Drawing Sheets

PAPER STORING DEVICE WITH A SWINGABLE ENGAGING MEMBER AND AN ENGAGING/DETACHING MECHANISM

BACKGROUND OF THE INVENTION

1. Field of the Invention

The present invention relates generally to a paper feeding device in an image forming apparatus such as a copying machine, and more particularly, to a paper feeding device having a pullout type paper feeding deck.

2. Description of the Prior Art

There has been conventionally known a paper feeding device 200 provided side by side with a main unit of a copying machine 100 and having a plurality of pullout type paper feeding decks 201, as shown in FIG. 6. A lot of recording paper sheets are laminated and mounted on an up-and-down tray 202 in each of the paper feeding decks 201. Each of the paper feeding decks 201 moves back and forth and is provided with a width aligning guide 203 sliding in the direction in which the paper feeding deck 201 moves so as to position the recording paper sheets.

In order to contain the recording paper sheets in the paper feeding deck 201, the paper feeding deck 201 is first pulled out of the paper feeding device 200 and then, the position of the width aligning guide 203 is adjusted depending on the size of the recording paper sheets. The recording paper sheets are then mounted on the up-and-down tray 202, as shown in FIG. 7. The paper feeding deck 201 is pushed into the paper feeding device 200 to be returned to the normal position.

When the paper feeding deck 201 is returned to the normal position, however, the width aligning guide 203 is made to flex, as shown in FIG. 8, due to the shock and the weight of the recording paper sheets, so that the recording paper sheets are not precisely positioned in the paper feeding position.

A reinforcing member corresponding to the size of the recording paper sheets has been conventionally fitted between the width aligning guide 203 and a back plate 204 at the rear thereof.

The conventional method of fitting the reinforcing member corresponding to the size of the recording paper sheets between the width aligning guide 203 and the back plate 204 at the rear thereof has the disadvantage of being laborious because the reinforcing member must be replaced every time the size of recording paper sheets is altered. In addition, it has the disadvantage in that reinforcing members of a plurality of types of sizes must be prepared corresponding to the sizes of the recording paper sheets, so that it is not easy to store the reinforcing members.

SUMMARY OF THE INVENTION

An object of the present invention is to provide a paper feeding device capable of stably supporting a width aligning guide in a predetermined position by a simple operation to precisely position recording paper sheets in the paper feeding position.

In a paper feeding device having a paper feeding deck, which moves back and forth, provided with a width aligning guide movable in the direction in which the paper feeding deck moves and for positioning recording paper sheets, the paper feeding device according to the present invention comprises a guide bar provided for the paper feeding deck so as to extend in the direction in which the paper feeding deck moves and having annular grooves formed in required portions corresponding to the sizes of the recording paper sheets, a width aligning guide supporting member fixed to the above width aligning guide and guided by the above guide bar, an engaging member provided for the above width aligning guide supporting member and detachably engaged with the annular groove of the above guide bar, and an engaging and detaching mechanism provided for the above width aligning guide supporting member and for engaging and detaching the above engaging member with and from the annular groove.

A tray mounted with the recording paper sheets being overlapped with each other is disposed movably up and down with respect to a bottom plate of the above paper feeding deck above the bottom plate. The above width aligning guide is guided in the direction in which the paper feeding deck moves to the above bottom plate of the above paper feeding deck by, for example, a rail member. The above tray is provided with a hole for moving the width aligning guide, which is long in the direction in which the paper feeding deck moves, through which the above width aligning guide is passed.

A swing member, swingably mounted on the above width aligning guide supporting member and having in its swing end a claw which can be engaged with the annular groove of the above guide bar, for example, is used as the above engaging member. Used as above, the engaging and detaching mechanism is, for example, one comprising urging member such as a spring for urging the above swing member in the direction in which the claw of the above swing member is engaged with the annular groove of the above guide bar and an operating member for operating the above swing member in the direction in which the claw of the above swing member is detached from the annular groove of the above guide bar.

Furthermore, used as the above engaging member may be a swing member swingably mounted on the above width aligning guide supporting member and disposed below the above guide bar, and an upward claw which can be engaged with the annular groove of the above guide bar may be formed in the swing end of the above swing member. In addition, used as above, the engaging and detaching mechanism may be one comprising an urging spring for urging the above swing member in the upward direction in which the above claw of the above swing member is engaged with the annular groove of the above guide bar and an operating bar supported movably up and down on the above width aligning guide and having a projection received on the side of the swing end of the above swing member, and the engaging and detaching mechanism may be so adapted that the lower end of the above operating bar is passed through a hole for moving the operating bar, which is long in the direction in which the paper feeding deck moves, formed in the above bottom plate, a downward rack-shaped member extending along the above hole for moving the operating bar is fixed to the lower surface of the above bottom plate, and an engaging member engaged with teeth of the above rack-shaped member when the above claw of the above swing member is engaged with the annular groove of the above guide bar is formed in the lower end of the above operating bar.

The operation of the paper feeding device according to the present invention is performed in the following. More specifically, the engaging member is detached from the annular groove of the guide bar by the engaging and detaching mechanism and then, the width aligning guide, along with the width aligning guide supporting member, is moved to a position corresponding to the size of the recording paper sheets. The engaging member is engaged with the annular groove of the guide bar by the engaging and detaching mechanism. Consequently, the width aligning guide is stably supported on the guide bar in a predetermined position.

According to the present invention, the width aligning guide can be stably supported in a predetermined position by a simple operation, thereby to make it possible to precisely position the recording paper sheets in the paper feeding position.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 1 is a plan view showing a paper feeding deck;

FIG. 2 is a perspective view taken along a line II—II indicated in FIG. 1;

FIG. 3 is an enlarged partial horizontal sectional view showing a width aligning guide and a grip;

FIG. 4 is a cross sectional view taken along a line IV—IV indicated in FIG. 3;

FIG. 5 is a cross sectional view taken along a line V—V indicated in FIG. 3; FIG. 6 is a perspective view showing a paper feeding device;

FIG. 7 is a side view showing a state where recording paper sheets are contained in a paper feeding deck; and FIG. 8 is a schematic view showing a state where the paper feeding deck is pushed into a main unit of the paper feeding device.

DESCRIPTION OF THE PREFERRED EMBODIMENTS

Referring now to FIGS. 1 to 5, description is made of an embodiment of the present invention.

In the following description, "front", "rear", "left", and "right" respectively mean the left side, the right side, the upper side, and the lower side of FIG. 1.

Figure 1:
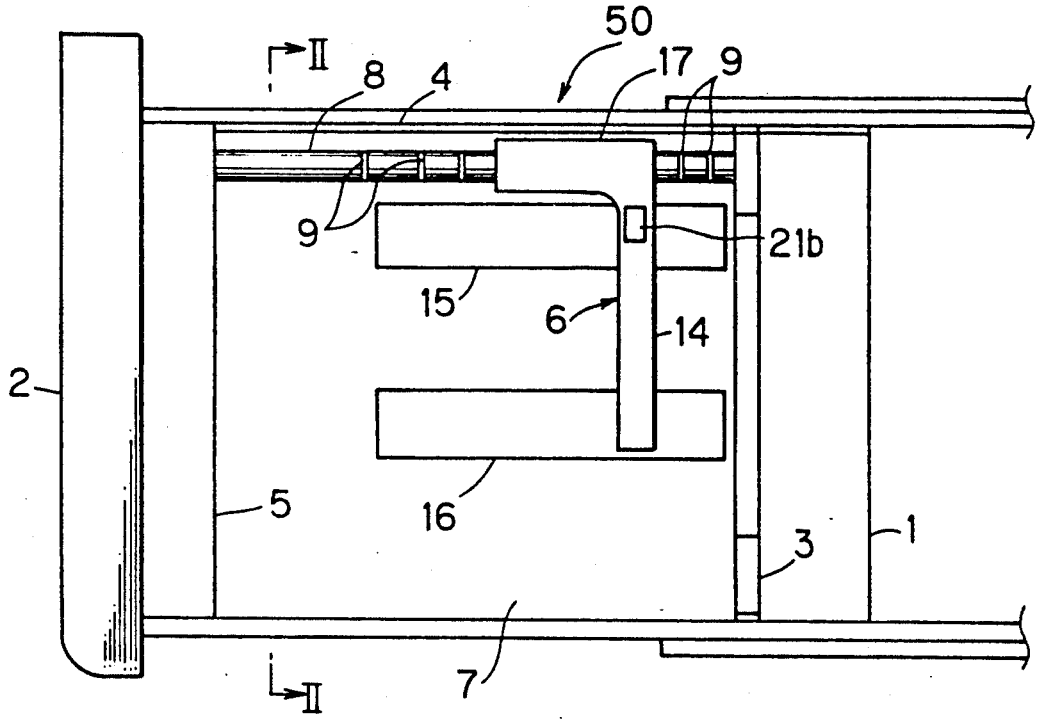
FIGS. 1 to 5 show an embodiment of the present invention, where
Figure 2:
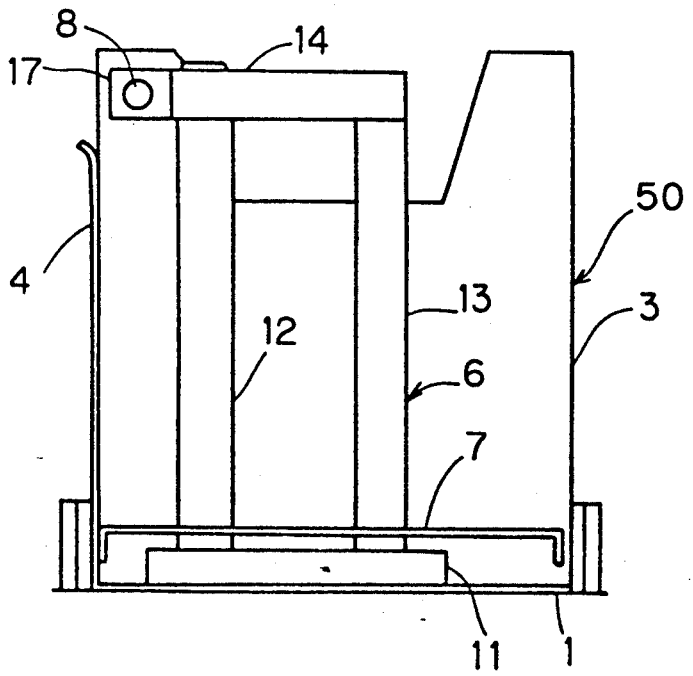

FIGS. 1 and 2 show a paper feeding deck in a paper feeding device. The paper feeding deck 50 moves back and forth and comprises a bottom plate 1, a front plate 2 fixed to the front end of the bottom plate 1, a back plate 3 fixed near the rear end of the bottom plate 1, a left side plate 4 fixed to the left side part of the bottom plate 1, a recording paper front end guide plate 5 fixed to the rear surface of the front plate 2, a recording paper width aligning guide 6 guided to the bottom plate 1 movably in the direction in which the paper feeding deck 50 moves, an up-and-down tray 7 supported movably up and down on the recording paper front end guide plate 5 and the back plate 3, and the like.

A guide bar 8, which is circular in cross section, extending in the direction in which the paper feeding deck 50 moves is stretched between the recording paper front end guide plate 5 and the back plate 3 in the upper lefthand part of the paper feeding deck 50. The guide bar 8 is provided with annular grooves 9 in a plurality of required portions corresponding to the sizes of the recording paper sheets. The up-and-down tray 7 is moved up and down by an electric motor (not shown).

The width aligning guide 6 comprises a base stand 11 supported movably in the direction in which the paper feeding deck 50 moves on the bottom plate 1 through a rail member (not shown), a pair of right and left vertical members 12 and 13 having their lower ends fixed to the base stand 11 and being in an approximately U shape in cross section and opened at the rear thereof, and a cylindrical grip 14 supported on the upper ends of both the vertical members 12 and 13. The up-and-down tray 7 is provided with guide holes 15 and 16, which are long in the direction in which the paper feeding deck 50 moves, through which the vertical members 12 and 13 are respectively passed.

Figure 3:
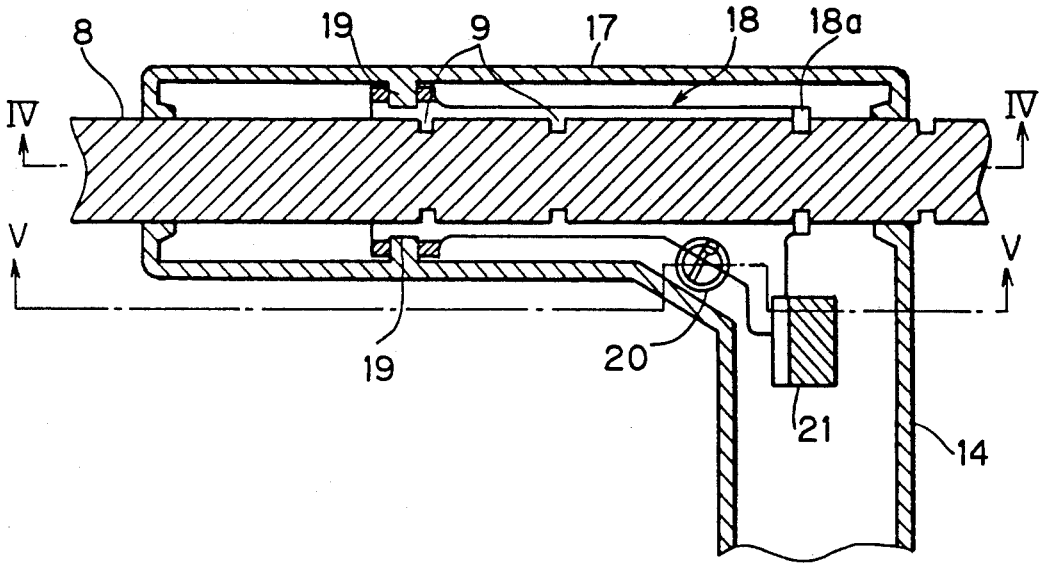
Figure 4:
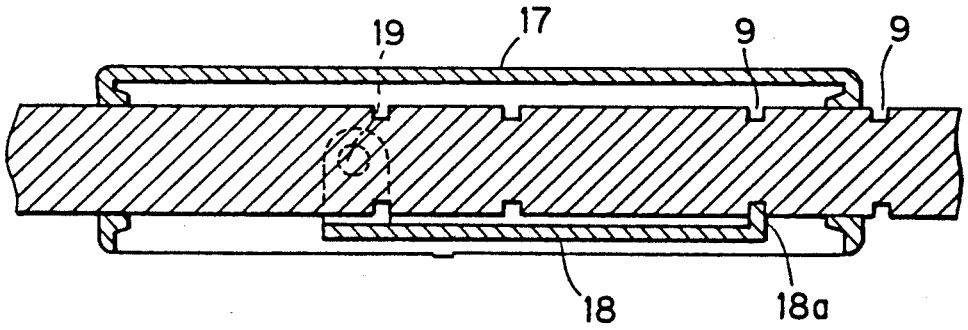
Figure 5:
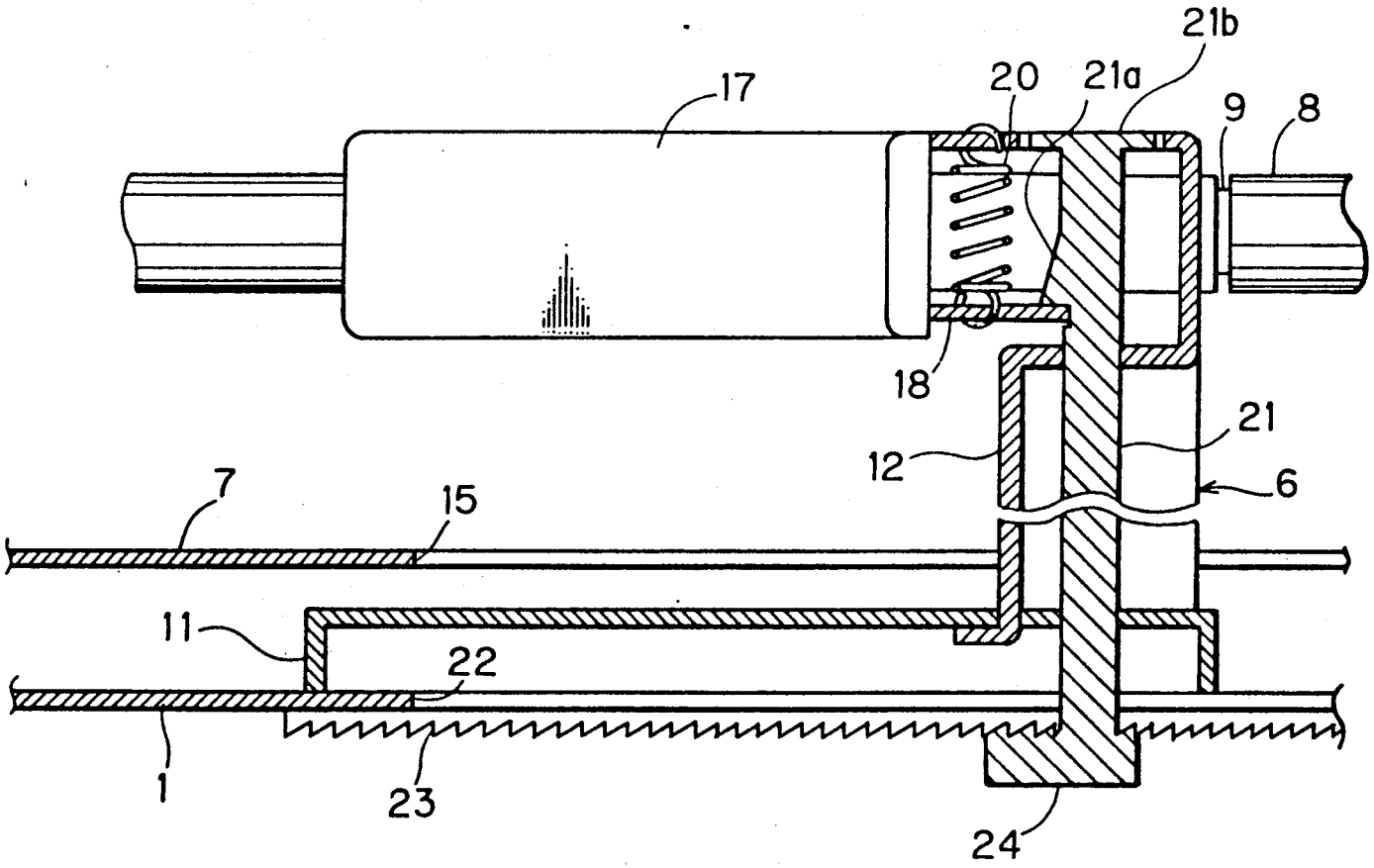
Figure 6:
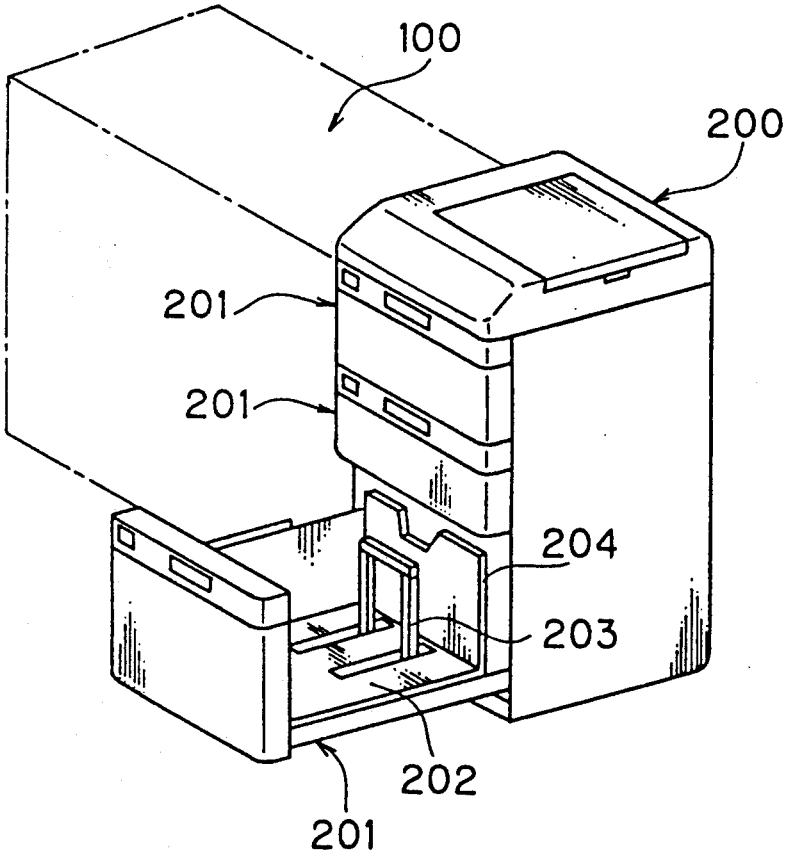
FIG. 6 (PRIOR ART)
FIGS. 6 to 8 are diagrams for explaining a conventional example, where
Figure 7:
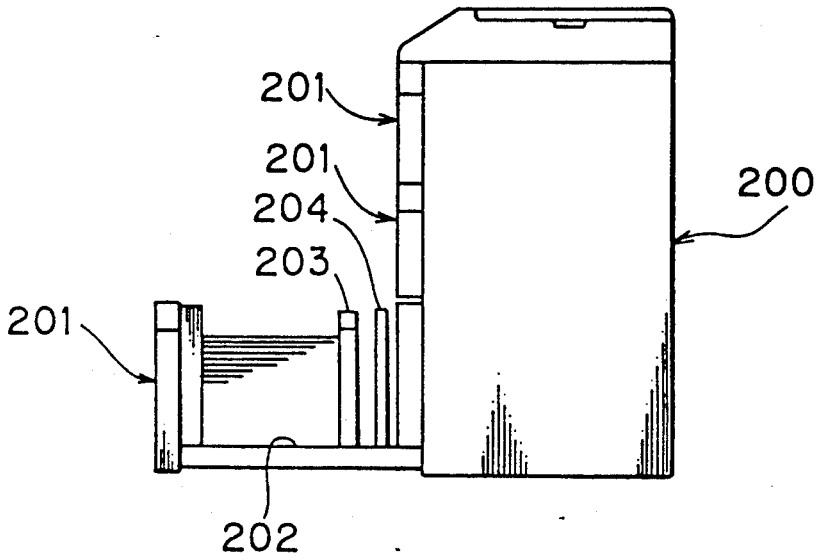
FIG. 7 (PRIOR ART)
Figure 8:
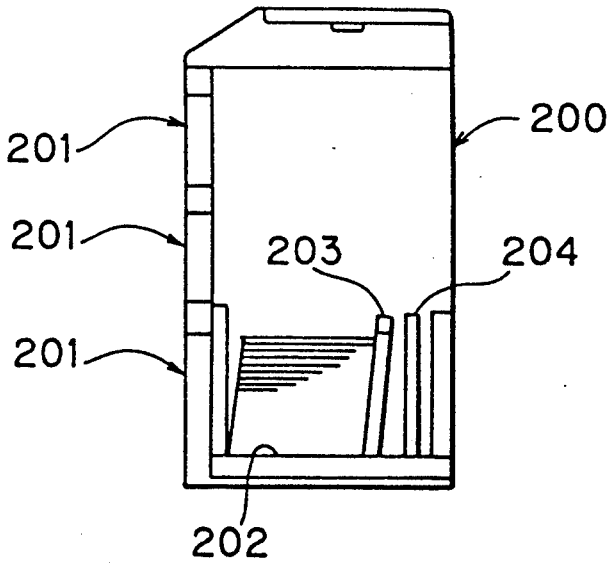
FIG. 8 (PRIOR ART)

Also referring to FIGS. 3 to 5, a hollow width aligning guide supporting member 17 extending in the direction in which the paper feeding deck 50 moves is integrally provided in the left side part of the grip 14. The guide bar 8 is passed through this supporting member 17, and the supporting member 17 is movable along the guide bar 8. A swing member 18, disposed in the supporting member 17 and having in its end a claw **18*a* which can be engaged with the annular groove 9 is swingably mounted on the supporting member 17 by a supporting shaft 19. The swing member 18 is urged in a counterclockwise direction, that is, in the direction at which the claw 18*a* is engaged with the annular groove 9, by a spring 20, and is always held with the claw 18*a* being engaged with the annular groove 9**.

Furthermore, an operating bar 21 for operating the swing member 18 is passed through the left side part of the grip 14, the base stand 11 in the width aligning guide 6 and the bottom plate 1. The operating bar 21 is passed along the inner wall of the vertical member 12 on the left side out of the vertical members 12 and 13 in the width aligning guide 6.

The lower end of the operating bar 21 is passed through a guide hole 22, which is long in the direction in which the paper feeding deck 50 moves, formed in the bottom plate 1. A rack-shaped member 23 extending in the direction in which the paper feeding deck 50 moves is fixed to one side part of the guide hole 22 on the lower surface of the bottom plate 1.

A projection **21*a* received on the upper surface of the right side part in the rear end of the swing member 18 is formed near the upper end 21*b* of the operating bar 21, and the operating bar 21 is always in its upper position. An engaging tooth 24 which can be engaged with teeth of the rack-shaped member 23 is attached to the lower end of the operating bar 21. When the operating bar 21 is in its upper position, the engaging tooth 24 is engaged with the teeth of the rack-shaped member 23**.

In the above described construction, in order to position the width aligning guide 6 corresponding to the size of the recording paper sheets, the upper end of the operating bar 21 is first pushed to lower the operating bar 21. Consequently, the swing member 18 swings in a clockwise direction by the projection **21*a* of the operating bar 21, so that the claw 18*a* comes off the annular groove 9. In addition, the engaging tooth 24 comes off the rackshaped member 23 by lowering the operating bar 21**.

Then, the grip 14 is held to move the width aligning guide 6 to a predetermined position corresponding to the size of the recording paper sheets with the upper end of the operating bar 21 being pushed. Thereafter, the operating bar 21 is released. Consequently, the swing member 18 swings in a counterclockwise direction and the operating bar 21 is lifted upward by the urging force of the spring 20. The claw 18*a* is engaged with the annular groove 9 corresponding to the size of the recording paper sheets, and the engaging tooth 24 is engaged with the rackshaped member 23. Therefore, the width aligning guide 6 is firmly supported in position.

The engaging tooth 24 may be replaced with a friction member made of rubber. In this case, the bottom plate 1 need not be provided with the rack-shaped member 23.

Furthermore, the rack-shaped member 23 may be replaced with a member having notches formed in positions corresponding to the annular grooves 9 of the guide bar 8, and the engaging tooth 24 may be replaced with a claw which can be engaged with the notch.

Additionally, although the annular grooves 9 are formed in the guide bar 8, notches which are not annular may be formed in the guide bar 8.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. In a paper feeding device having a paper feeding deck which moves back and forth and is provided with a width aligning guide movable in a direction in which the paper feeding deck moves for positioning of recording paper sheets, the paper feeding device comprising:

a guide bar provided for the paper feeding deck so as to extend in the direction in which the paper feeding deck moves, the guide bar having grooves formed at positions corresponding to sizes of recording paper sheets;

a width aligning guide supporting member fixed to the width aligning guide and guided by the guide bar;

an engaging member provided for the width aligning guide supporting member and being detachably engagable with the grooves of the guide bar;

an engaging and detaching mechanism, provided for the width aligning guide supporting member, for causing the engaging member to engage with and disengage from the grooves of the guide bar;

a tray mounted with overlapping recording paper sheets, the tray being movable up and down with respect to a bottom plate of the paper feeding deck, and being disposed above the bottom plate, the width aligning guide being guided in the direction in which the paper feeding deck moves to the bottom plate of the paper feeding deck by a rail member, the tray having a hole through which the width aligning guide passes for permitting movement of the width aligning guide, the hole being long in the direction in which the paper feeding deck moves, the engaging member comprising a swing member mounted swingably on the width aligning guide supporting member and being disposed below the guide bar, the swing member having a swing end with an upwardly oriented claw which can be engaged with a groove of the guide bar, the engaging and detaching mechanism comprising an urging spring for urging the swing member in an upward direction of the claw of the swing member when the claw is engaged with a groove of the guide bar, and an operating bar supported so as to be movable up and down on the width aligning guide, the operating bar having a projection received on the side of the swing end of the swing member, and a lower end which passes through a hole for permitting moving of the operating bar, the hole being long in the direction in which the paper feeding deck moves and being formed in the bottom plate;

a first member, extending along the hole, being fixed to a lower surface of the bottom plate; and a second member, engagable with the first member when the claw of the swing member is engaged with a groove of the guide bar, being formed at a lower end of the operating bar.

2. The paper feeding device according to claim 1, wherein the width aligning guide comprises a base stand guided in the direction in which the paper feeding deck moves to the bottom plate of the paper feeding deck by the rail member, a vertical member having a lower end fixed to the base stand, and a grip supported on an upper end of the vertical member, the lower end of the operating bar passing through the hole in the bottom plate and along the inner wall of the vertical member.

3. The paper feeding device according to claim 1, wherein the first member is a rack-shaped member, and the second member is an engaging tooth which can be engaged with teeth of the rack-shaped member.

4. In a paper feeding device having a paper feeding deck which moves back and forth and is provided with a width aligning guide movable in a direction in which the paper feeding deck moves for positioning of recording paper sheets, the paper feeding device comprising:

a guide bar provided for the paper feeding deck so as to extend in the direction in which the paper feeding deck moves, the guide bar having grooves formed at positions corresponding to sizes of recording paper sheets;

a width aligning guide supporting member fixed to the width aligning guide and guided by the guide bar;

an engaging member provided for the width aligning guide supporting member and being detachably engagable with the grooves of the guide bar; and an engaging and detaching mechanism, provided for the width aligning guide supporting member, for causing the engaging member to engage with and disengage from the grooves of the guide bar, the engaging member comprising a swing member swingably mounted on the width aligning guide supporting member, the swing member having a swing end with a claw which can be engaged with a groove of the guide bar, and the engaging and detaching mechanism comprising urging means for urging the swing member in a direction in which the claw of the swing member can engage with a groove of the guide bar, and an operating member for operating the swing member in a direction in which the claw of the swing member detaches from a groove of the guide bar.

5. In a paper feeding device having a paper feeding deck which moves back and forth and is provided with a width aligning guide movable in a direction in which the paper feeding deck moves for positioning of recording paper sheets, the paper feeding device comprising:

a guide bar provided for the paper feeding deck so as to extend in the direction in which the paper feeding deck moves, the guide bar having grooves formed at positions corresponding to sizes of recording paper sheets;

a width aligning guide supporting member fixed to the width aligning guide and guided by the guide bar;

an engaging member provided for the width aligning guide supporting member and being detachably engagable with the grooves of the guide bar;

an engaging and detaching mechanism, provided for the width aligning guide supporting member, for causing the engaging member to engage with and disengage from the grooves of the guide bar; and a tray mounted with overlapping recording paper sheets, the tray being movable up and down with respect to a bottom plate of the paper feeding deck, and being disposed above the bottom plate, the width aligning guide being guided in the direction in which the paper feeding deck moves to the bottom plate of the paper feeding deck by a rail member, the tray having a hole through which the width aligning guide passes for permitting movement of the width aligning guide, the hole being long in the direction in which the paper feeding deck moves, the engaging member comprising a swing member swingably mounted on the width aligning guide supporting member, the swing member having a swing end with a claw which can be engaged with a groove of the guide bar, and the engaging and detaching mechanism comprising urging means for urging the swing member in a direction in which the claw of the swing member can engage with a groove of the guide bar, and an operating member for operating the swing member in a direction in which the claw of the swing member detaches from a groove of the guide bar.

6. The paper feeding device according to claim 5, wherein the bottom plate is provided with a first member, and the operating member is provided with a second member which is located at a lower end thereof and which can be engaged with the first member.

7. The paper feeding device according to claim 6, wherein the width aligning guide comprises a base stand guided in the direction in which the paper feeding deck moves to the bottom plate of the paper feeding deck by the rail member, a vertical member having its lower end fixed to the base stand, and a grip supported on the upper end of the vertical member, the operating member extending to the bottom plate along the inner wall of the vertical member.

8. The paper feeding device according to claim 6, wherein the first member is a rack-shaped member, and the second member is an engaging tooth which can be engaged with teeth of the rack-shaped member.

9. The paper feeding device according to claim 5, wherein the urging means is a spring.

* * * * *